US010589398B2

(12) United States Patent
Eto et al.

(10) Patent No.: US 10,589,398 B2
(45) Date of Patent: Mar. 17, 2020

(54) HEAT EXCHANGER FOR REGULATING SURFACE TEMPERATURE OF A POLISHING PAD, POLISHING APPARATUS, POLISHING METHOD, AND MEDIUM STORING COMPUTER PROGRAM

(71) Applicant: EBARA CORPORATION, Tokyo (JP)

(72) Inventors: Yohei Eto, Tokyo (JP); Toru Maruyama, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 230 days.

(21) Appl. No.: 15/883,978

(22) Filed: Jan. 30, 2018

(65) Prior Publication Data

US 2018/0236631 A1 Aug. 23, 2018

(30) Foreign Application Priority Data

Feb. 2, 2017 (JP) ..... 2017-17401

(51) Int. Cl.

| | |
|---|---|
| ***B24B 37/015*** | (2012.01) |
| ***B24B 55/02*** | (2006.01) |
| ***B24B 49/14*** | (2006.01) |
| ***B24B 57/02*** | (2006.01) |
| ***B24B 37/10*** | (2012.01) |
| *F28F 3/12* | (2006.01) |

(52) U.S. Cl.

CPC ..... *B24B 37/015* (2013.01); *B24B 37/107* (2013.01); *B24B 49/14* (2013.01); *B24B 55/02* (2013.01); *B24B 57/02* (2013.01); *F28F 3/12* (2013.01); *F28F 2210/10* (2013.01)

(58) Field of Classification Search

CPC ..... B24B 37/015; B24B 37/107; B24B 49/14; B24B 55/02; B24B 57/02; F28F 3/12; F28F 2210/10

See application file for complete search history.

(56) References Cited

U.S. PATENT DOCUMENTS

| | | | | |
|---|---|---|---|---|
| 9,782,870 | B2 * | 10/2017 | Maruyama | B24B 37/015 |
| 10,099,340 | B2 * | 10/2018 | Motoshima | B24B 55/02 |
| 2011/0159782 | A1 * | 6/2011 | Sone | B24B 37/015 451/7 |
| 2012/0220196 | A1 * | 8/2012 | Maruyama | B24B 37/015 451/7 |

FOREIGN PATENT DOCUMENTS

JP 2015-044245 A 3/2015

* cited by examiner

*Primary Examiner* — Dung Van Nguyen
(74) *Attorney, Agent, or Firm* — Baker Hostetler

(57) ABSTRACT

A heat exchanger which can allow a surface temperature of a polishing pad to promptly reach a target temperature and can realize a uniform distribution of the surface temperature of the polishing pad is disclosed. The heat exchanger includes a pad contact surface capable of contacting the polishing pad, a heating flow passage through which a heating fluid is to flow, and a cooling flow passage through which a cooling fluid is to flow. The heating flow passage and the cooling flow passage are arranged side by side from beginnings to ends thereof, and the heating flow passage and the cooling flow passage cross each other at different levels at a peripheral portion of the pad contact surface.

7 Claims, 12 Drawing Sheets

HEAT EXCHANGER FOR REGULATING SURFACE TEMPERATURE OF A POLISHING PAD, POLISHING APPARATUS, POLISHING METHOD, AND MEDIUM STORING COMPUTER PROGRAM

CROSS REFERENCE TO RELATED APPLICATION

This document claims priority to Japanese Patent Application Number 2017-17401 filed Feb. 2, 2017, the entire contents of which are hereby incorporated by reference.

BACKGROUND

A CMP (chemical mechanical polishing) apparatus is used in a process of polishing a surface of a wafer in the manufacturing of a semiconductor device. The CMP apparatus is configured to hold and rotate the wafer with a polishing head, and press the wafer against a polishing pad on a rotating polishing table to polish the surface of the wafer. During polishing, a polishing liquid (or slurry) is supplied onto the polishing pad, so that the surface of the wafer is planarized by the chemical action of the polishing liquid and the mechanical action of abrasive grains contained in the polishing liquid.

A polishing rate of the wafer depends not only on a polishing load on the wafer pressed against the polishing pad, but also on a surface temperature of the polishing pad. This is because the chemical action of the polishing liquid on the wafer depends on the temperature. The polishing rate is an index indicating an amount (or a thickness) of a film of the wafer removed per unit time as a result of the polishing operation. The polishing rate is also referred to as removal rate.

Therefore, a CMP apparatus capable of regulating the surface temperature of the polishing pad has been developed. This type of CMP apparatus has a pad-temperature sensor and a pad-temperature regulation system. The pad-temperature sensor is arranged so as to measure the surface temperature of an area of the polishing pad that contacts the center of the wafer. The pad-temperature regulation system is configured to bring a heat exchanger into contact with the surface of the polishing pad to regulate the surface temperature of the polishing pad based on a measured value of the surface temperature of the polishing pad.

FIG. 12 is a diagram showing an example of a conventional heat exchanger. When a surface temperature of a polishing pad 200 is to be regulated such that a uniform temperature distribution is provided, a heat exchanger 201 is required to have a heating-fluid area 201A and a cooling-fluid area 201B inside thereof, as shown in FIG. 12. The heating-fluid area 201A constitutes a half of the inside of the heat exchanger 201, and the cooling-fluid area 201B constitutes the other half of the inside of the heat exchanger 201. With this configuration, as a polishing table 202 rotates, the heating-fluid area 201A and the cooling-fluid area 201B evenly contact the surface of the polishing pad 200, and as a result, a uniform temperature distribution is obtained. However, in order to shorten the polishing time, the surface temperature should quickly reach a desired target temperature. It takes time for the arrangement shown in FIG. 12 to reach the desired target temperature.

Thus, as shown in FIG. 13, there is a proposed heat exchanger 210 having a heating-fluid passage 208 and a cooling-fluid passage 209 which are arranged spirally. According to such an arrangement, it is possible to promptly reach a desired target temperature. However, in a peripheral portion of the heat exchanger 210, one of the heating-fluid passage 208 and the cooling-fluid passage 209 is dominant over another. As a result, the temperature distribution on the surface of the polishing pad 200 becomes nonuniform.

SUMMARY OF THE INVENTION

According to an embodiment, there is provided a heat exchanger which can allow a surface temperature of a polishing pad to promptly reach a target temperature and can realize a uniform distribution of the surface temperature of the polishing pad. According to another embodiment, there is provided a polishing apparatus having such a heat exchanger. Further, according to still another embodiment, there is provided a method of polishing a substrate using the heat exchanger.

Embodiments, which will be described below, relate to a heat exchanger for regulating a surface temperature of a polishing pad for use in polishing of a substrate, such as a wafer. The below-described embodiments also relate to a polishing apparatus having such a heat exchanger and a polishing method.

In an embodiment, there is provided a heat exchanger for regulating a surface temperature of a polishing pad by contacting a surface of the polishing pad, comprising: a pad contact surface capable of contacting the polishing pad; a heating flow passage through which a heating fluid is to flow; and a cooling flow passage through which a cooling fluid is to flow, wherein the heating flow passage and the cooling flow passage are arranged side by side from beginnings to ends thereof, and the heating flow passage and the cooling flow passage cross each other at different levels at a peripheral portion of the pad contact surface.

In an embodiment, the heating flow passage and the cooling flow passage comprise zigzag passages.

In an embodiment, folded-back portions of the heating flow passage and folded-back portions of the cooling flow passage overlap each other.

In an embodiment, folded-back portions of the heating flow passage and folded-back portions of the cooling flow passage are located right above the peripheral portion of the pad contact surface.

In an embodiment, there is provided a polishing apparatus comprising: a rotatable polishing table for supporting a polishing pad; a polishing head configured to press a substrate against a surface of the polishing pad so as to polish the substrate; the above-described heat exchanger configured to contact the surface of the polishing pad so as to regulate a surface temperature of the polishing pad; a heating-fluid supply pipe configured to supply a heating fluid to the heat exchanger; and a cooling-fluid supply pipe configured to supply a cooling fluid to the heat exchanger.

In an embodiment, there is provided a substrate polishing method comprising: holding a substrate with a polishing head; and pressing the substrate by the polishing head against a surface of a polishing pad to polish the substrate, while placing the above-described heat exchanger, through which a heating fluid and a cooling fluid flow, in contact with the surface of the polishing pad so as to regulate a surface temperature of the polishing pad.

In an embodiment, there is provided a non-transitory computer-readable storage medium storing therein a program that instructs a computer to perform the above-described substrate polishing method, the computer being configured to control operations of a polishing apparatus.

According to the above-described embodiments, both the heating flow passage and the cooling flow passage are located over the entirety of the pad contact surface. In particular, both the heating fluid and the cooling fluid exist at points where the heating flow passage and the cooling flow passage cross each other. This arrangement can prevent the local heating with only the heating fluid and the local cooling with only the cooling fluid. In other words, the heat exchanger can regulate the surface temperature of the polishing pad with both the heating fluid and the cooling fluid in the entirety of the pad contact surface. Therefore, the heat exchanger can provide a uniform distribution of the surface temperature of the polishing pad. Furthermore, the polishing apparatus having the above-discussed heat exchanger can polish a substrate, such as a wafer, to provide a uniform polishing profile.

DESCRIPTION OF EMBODIMENTS

Embodiments will now be described with reference to the drawings.

Figure 1:
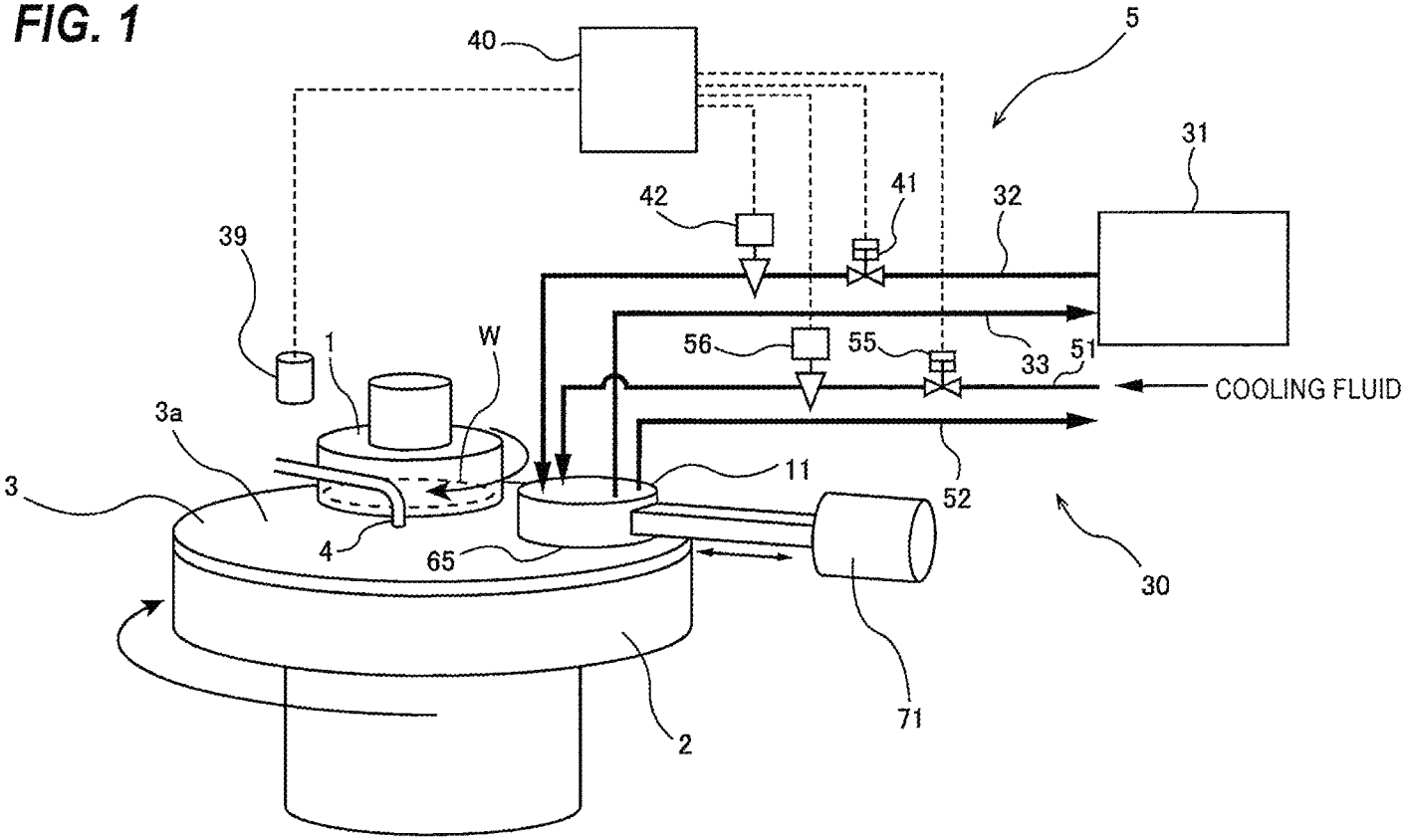
FIG. 1 is a schematic view showing a polishing apparatus.

FIG. 1 is a schematic view of a polishing apparatus. As shown in FIG. 1, the polishing apparatus includes a polishing head 1 for holding and rotating a wafer W which is an example of a substrate, a polishing table 2 that supports a polishing pad 3, a polishing-liquid supply nozzle 4 for supplying a polishing liquid (e.g. a slurry) onto a surface of the polishing pad 3, and a pad-temperature regulation system 5 for regulating a surface temperature of the polishing pad 3. The surface (upper surface) 3*a* of the polishing pad 3 provides a polishing surface for polishing the wafer W.

The polishing head 1 is vertically movable, and is rotatable about its axis in a direction indicated by arrow. The wafer W is held on a lower surface of the polishing head 1 by, for example, vacuum suction. A motor (not shown) is coupled to the polishing table 2, so that the polishing table 2 can rotate in a direction indicated by arrow. As shown in FIG. 1, the polishing head 1 and the polishing table 2 rotate in the same direction. The polishing pad 3 is attached to the upper surface of the polishing table 2.

Polishing of the wafer W is performed in the following manner. The wafer W, to be polished, is held by the polishing head 1, and is then rotated by the polishing head 1. The polishing pad 3 is rotated together with the polishing table 2. While the wafer W and the polishing pad 3 are rotating, the polishing liquid is supplied from the polishing-liquid supply nozzle 4 onto the surface of the polishing pad 3, and the surface of the wafer W is then pressed by the top ring 1 against the surface 3*a*, i.e. the polishing surface, of the polishing pad 3. The surface of the wafer W is polished by the sliding contact with the polishing pad 3 in the presence of the polishing liquid. The surface of the wafer W is planarized by the chemical action of the polishing liquid and the mechanical action of abrasive grains contained in the polishing liquid.

The pad-temperature regulation system 5 includes a heat exchanger 11 having flow passages formed therein through which fluids flow to regulate the surface temperature of the polishing pad 3. The pad-temperature regulation system 5 further includes a fluid supply system 30 for supplying a heating fluid having a regulated temperature and a cooling fluid having a regulated temperature into the heat exchanger 11. The heat exchanger 11 has a pad contact surface 65 which can contact the surface of the polishing pad 3.

The pad-temperature regulation system 5 further includes a translation mechanism 71 for moving the heat exchanger 11 parallel to the surface 3*a* of the polishing pad 3. The heat exchanger 11 is held by the translation mechanism 71. The translation mechanism 71 is configured to be able to move the heat exchanger 11 in a radial direction of the polishing pad 3 while the lower surface (i.e., the pad contact surface 65) of the heat exchanger 11 is in contact with the surface 3*a* of the polishing pad 3. The translation mechanism 71 may be composed of a combination of a servo motor and a ball screw mechanism, or a pneumatic cylinder.

The fluid supply system 30 includes a heating-fluid supply tank 31 as a heating-fluid supply source for holding the heating fluid having a regulated temperature therein, and a heating-fluid supply pipe 32 and a heating-fluid return pipe 33, each coupling the heating-fluid supply tank 31 to the heat exchanger 11. One ends of the heating-fluid supply pipe 32 and the heating-fluid return pipe 33 are coupled to the heating-fluid supply tank 31, and the other ends are coupled to the heat exchanger 11.

The heating fluid having a regulated temperature is supplied from the heating-fluid supply tank 31 to the heat exchanger 11 through the heating-fluid supply pipe 32, flows in the heat exchanger 11, and is returned from the heat exchanger 11 to the heating-fluid supply tank 31 through the heating-fluid return pipe 33. In this manner, the heating fluid circulates between the heating-fluid supply tank 31 and the heat exchanger 11. The heating-fluid supply tank 31 has a heater (not shown in the drawings), so that the heating fluid is heated by the heater to have a predetermined temperature.

A first on-off valve 41 and a first flow control valve 42 are attached to the heating-fluid supply pipe 32. The first flow control valve 42 is located between the heat exchanger 11 and the first on-off valve 41. The first on-off valve 41 is a valve not having a flow rate regulating function, whereas the first flow control valve 42 is a valve having a flow rate regulating function.

The fluid supply system 30 further includes a cooling-fluid supply pipe 51 and a cooling-fluid discharge pipe 52, both coupled to the heat exchanger 11. The cooling-fluid supply pipe 51 is coupled to a cooling-fluid supply source (e.g. a cold water supply source) provided in a factory in which the polishing apparatus is installed. The cooling fluid is supplied to the heat exchanger 11 through the cooling-fluid supply pipe 51, flows in the heat exchanger 11, and is drained from the heat exchanger 11 through the cooling-fluid discharge pipe 52. In one embodiment, the cooling fluid that has flowed through the heat exchanger 11 may be returned to the cooling-fluid supply source through the cooling-fluid discharge pipe 52.

A second on-off valve 55 and a second flow control valve 56 are attached to the cooling-fluid supply pipe 51. The second flow control valve 56 is located between the heat exchanger 11 and the second on-off valve 55. The second on-off valve 55 is a valve not having a flow rate regulating function, whereas the second flow control valve 56 is a valve having a flow rate regulating function.

The pad-temperature regulation system 5 further includes a pad-temperature measuring device 39 for measuring a surface temperature of the polishing pad 3 (which may hereinafter be referred to as pad surface temperature), and a valve controller 40 for operating the first flow control valve 42 and the second flow control valve 56 based on the pad surface temperature measured by the pad-temperature measuring device 39. The first on-off valve 41 and the second on-off valve 55 are usually open. The pad-temperature measuring device 39 is disposed above the surface of the polishing pad 3, and is configured to measure the surface temperature of the polishing pad 3 in a non-contact manner. The pad-temperature measuring device 39 is coupled to the valve controller 40.

The valve controller 40 is configured to calculate a manipulated variable for the first flow control valve 42 and a manipulated variable for the second flow control valve 56 which are necessary for eliminating a difference between a preset target temperature and the surface temperature of the polishing pad 3. The manipulated variable for the first flow control valve 42 and the manipulated variable for the second flow control valve 56 are, in other words, the degree of opening of the valve. The manipulated variable for the first flow control valve 42 is proportional to the flow rate of the heating fluid, and the manipulated variable for the second flow control valve 56 is proportional to the flow rate of the cooling fluid.

Where the manipulated variable for the first flow control valve 42 and the manipulated variable for the second flow control valve 56 are each expressed as a numerical value ranging from 0% to 100%, the valve controller 40 is configured to determine the manipulated variable for the second flow control valve 56 by subtracting the manipulated variable for the first flow control valve 42 from 100%. In one embodiment, the valve controller 40 may be configured to determine the manipulated variable for the first flow control valve 42 by subtracting the manipulated variable for the second flow control valve 56 from 100%.

When the manipulated variable for the first flow control valve 42 is 100%, it indicates that the first flow control valve 42 is fully open. When the manipulated variable for the first flow control valve 42 is 0%, it indicates that the first flow control valve 42 is fully closed. Similarly, when the manipulated variable for the second flow control valve 56 is 100%, it indicates that the second flow control valve 56 is fully open; when the manipulated variable for the second flow control valve 56 is 0%, it indicates that the second flow control valve 56 is fully closed.

The flow rate of the heating fluid when the manipulated variable for the first flow control valve 42 is 100% is equal to the flow rate of the cooling fluid when the manipulated variable for the second flow control valve 56 is 100%. Accordingly, the sum of the flow rate of the heating fluid passing through the first flow control valve 42 and the flow rate of the cooling fluid passing through the second flow control valve 56 is constant at all times.

The valve controller 40 operates the first flow control valve 42 and the second flow control valve 56 in such a manner that the sum of the manipulated variable for the first flow control valve 42 and the manipulated variable for the second flow control valve 56 is 100%.

Hot water may be used as the heating fluid to be supplied to the heat exchanger 11. The hot water that has been heated to about 80° C. by the heater of the heating-fluid supply tank 31 may be used. When it is intended to raise the surface temperature of the polishing pad 3 more quickly, a silicone oil may be used as the heating fluid. In the case of using a silicone oil as the heating fluid, the silicone oil may be heated to have a temperature of not less than 100° C. (e.g. about 120° C.). Cold water or a silicone oil may be used as the cooling fluid to be supplied to the heat exchanger 11. In the case of using a silicone oil as the cooling fluid, the polishing pad 3 can be cooled quickly by coupling a chiller as a cooling-fluid supply source to the cooling-fluid supply pipe 51, and by cooling the silicone oil to a temperature of not more than 0° C.

The heating-fluid supply pipe 32 and the cooling-fluid supply pipe 51 are completely independent pipes. Thus, the heating fluid and the cooling fluid can be supplied to the heat exchanger 11 without mixing with each other. The heating-fluid return pipe 33 and the cooling-fluid discharge pipe 52 are also completely independent pipes. Thus, the heating fluid is returned to the heating-fluid supply tank 31 without mixing with the cooling fluid, while the cooling fluid is either drained or returned to the cooling-fluid supply source without mixing with the heating fluid.

Figure 2:
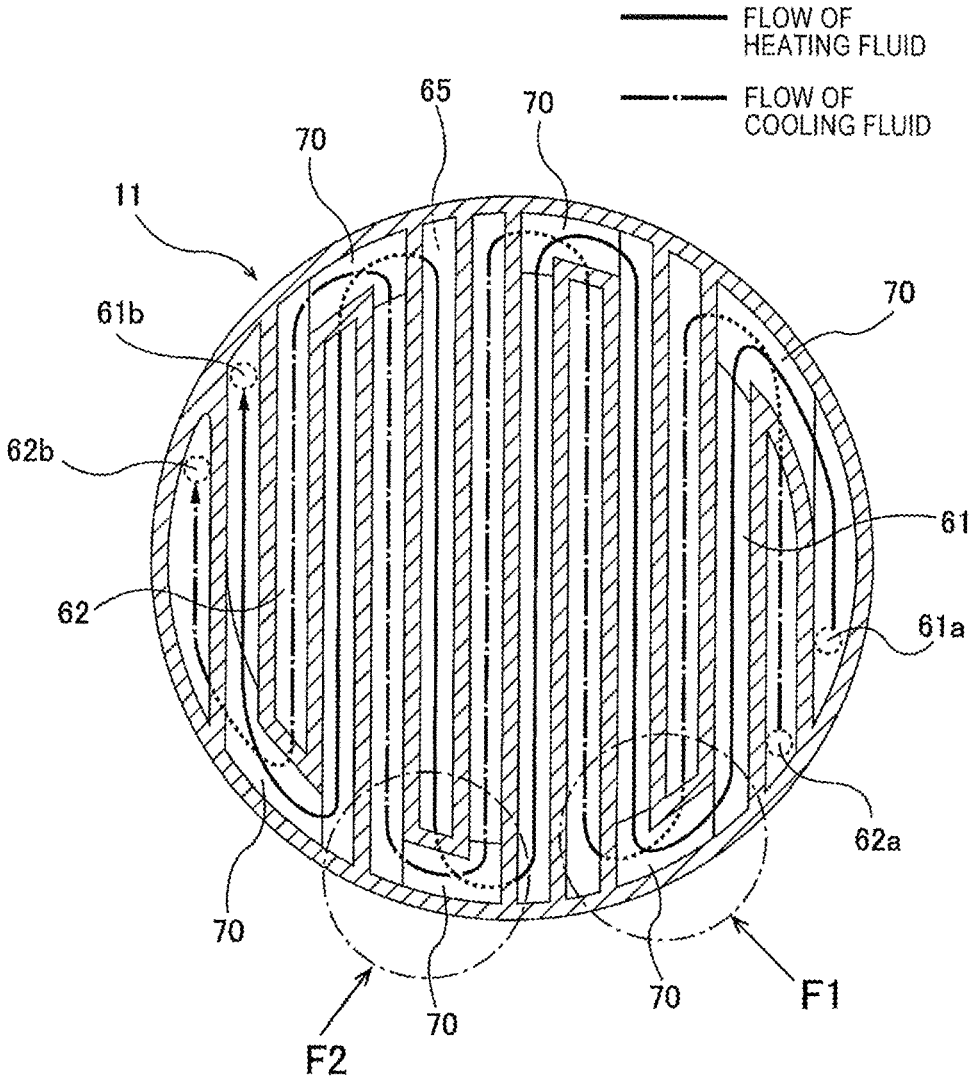
FIG. 2 is a horizontal cross-sectional view showing a heat exchanger shown in FIG. 1.
Figure 3:
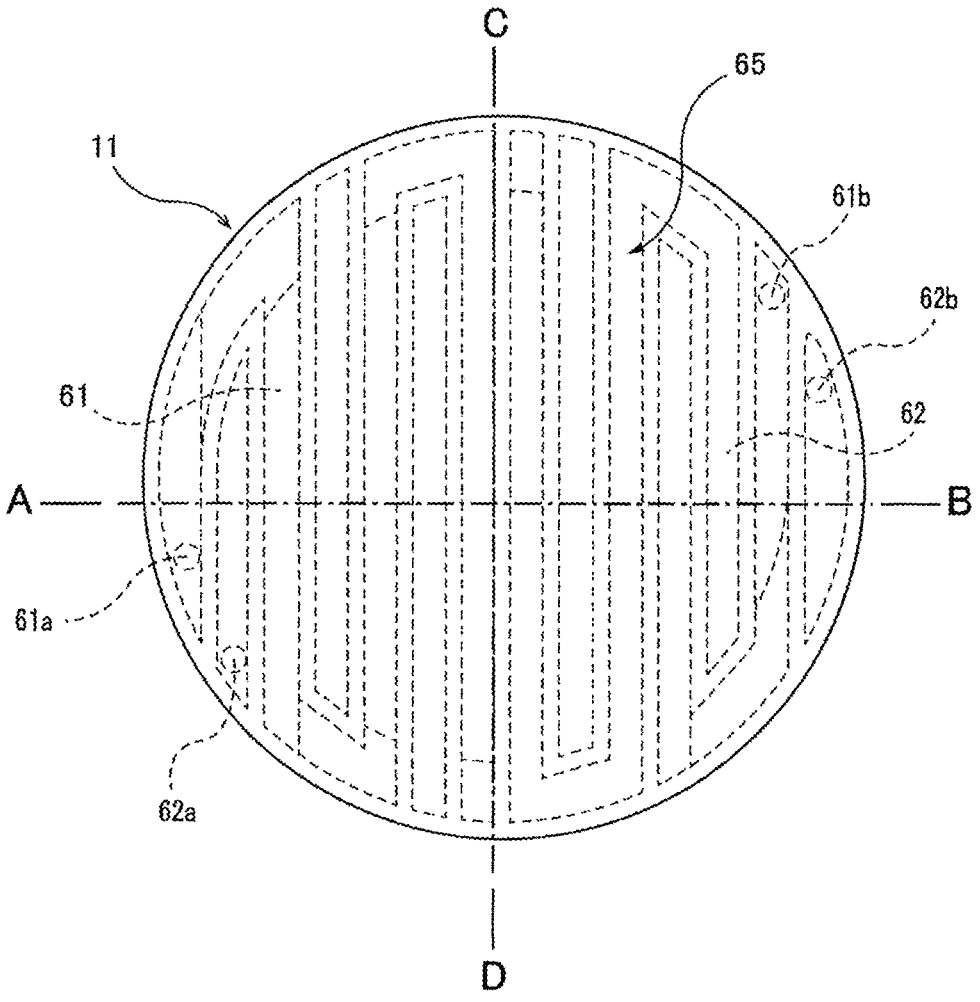
FIG. 3 is a bottom view of the heat exchanger.

Next, an embodiment of the heat exchanger 11 will be described. FIG. 2 is a horizontal cross-sectional view showing the heat exchanger 11, and FIG. 3 is a bottom view of the heat exchanger 11. The heat exchanger 11 is a pad contact member having a heating flow passage 61 and a cooling flow passage 62 formed therein. The heat exchanger 11 includes the heating flow passage 61 through which the heating fluid flows, the cooling flow passage 62 through which the cooling fluid flows, and the pad contact surface 65 capable of contacting the surface 3*a* of the polishing pad 3. In this embodiment, the pad contact surface 65 has a circular shape. In one embodiment, the pad contact surface 65 may have a polygonal shape such as a quadrangle, a pentagon, or the like. A material having excellent thermal conductivity, abrasion resistance, corrosion resistance, such as SiC or alumina, can be used as a material for forming the heating flow passage 61, the cooling flow passage 62, and the pad contact surface 65.

The heating flow passage 61 and the cooling flow passage 62 are arranged side by side from the beginnings to the ends thereof. In this embodiment, the heating flow passage 61 and the cooling flow passage 62 are constituted by zigzag passages which are adjacent to each other. The heating flow passage 61 has the same length as the cooling flow passage 62. The heating flow passage 61 and the cooling flow passage 62 are completely separated, so that the heating fluid and the cooling fluid are not mixed in the heat exchanger 11.

The heating flow passage 61 and the cooling flow passage 62 cross each other at different levels at a peripheral portion of the pad contact surface 65. More specifically, the heating flow passage 61 and the cooling flow passage 62 cross at different levels at a plurality of points aligned along the peripheral portion of the pad contact surface 65. The heating flow passage 61 and the cooling flow passage 62 have folded-back portions which are located right above the peripheral portion of the pad contact surface 65. Further, the folded-back portions of the heating flow passage 61 and the folded-back portions of the cooling flow passage 62 overlap each other. In this embodiment, the heating flow passage 61 and the cooling flow passage 62 cross each other right above the peripheral portion of the pad contact surface 65.

The heat exchanger 11 further includes a heating-fluid inlet 61*a*, a heating-fluid outlet 61*b*, a cooling-fluid inlet 62*a*, and a cooling-fluid outlet 62*b*. One end of the heating flow passage 61 is coupled to the heating-fluid inlet 61*a*, and the other end of the heating flow passage 61 is coupled to the heating-fluid outlet 61*b*. One end of the cooling flow passage 62 is coupled to the cooling-fluid inlet 62*a*, and the other end of the cooling flow passage 62 is coupled to the cooling-fluid outlet 62*b*. The heating-fluid inlet 61*a* is coupled to the heating-fluid supply pipe 32 (see FIG. 1), and the heating-fluid outlet 61*b* is coupled to the heating-fluid return pipe 33 (see FIG. 1). The cooling-fluid inlet 62*a* is coupled to the cooling-fluid supply pipe 51 (see FIG. 1), and the cooling-fluid outlet 62*b* is coupled to the cooling-fluid discharge pipe 52 (see FIG. 1).

Figure 4:
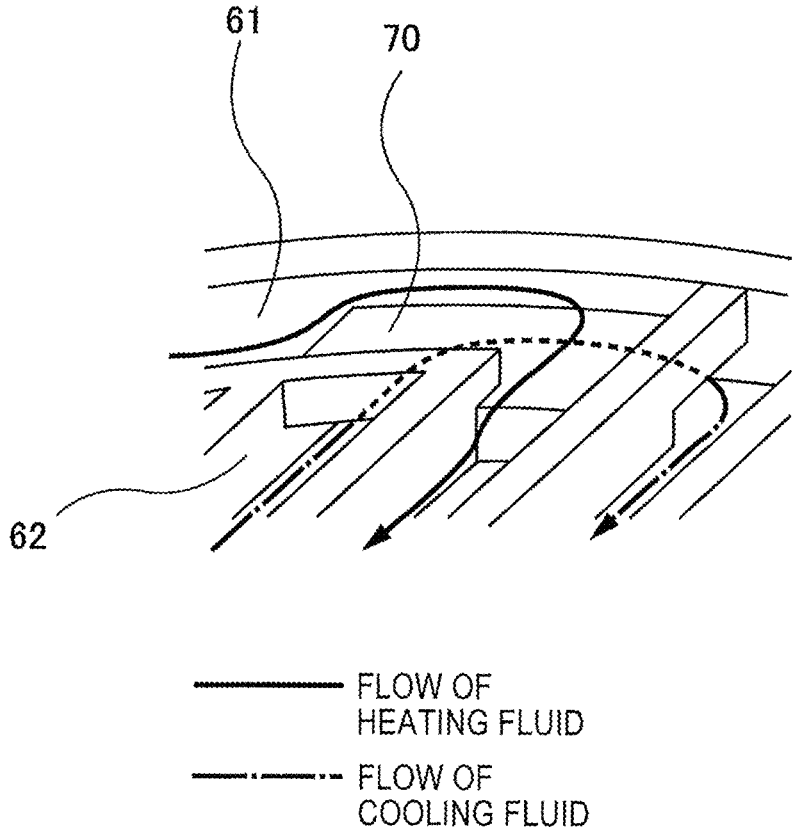
FIG. 4 is an enlarged perspective view of a portion of the heat exchanger indicated by symbol F1 in FIG. 2, and shows a point at which a heating flow passage and a cooling flow passage cross each other.

FIG. 4 is an enlarged perspective view of a portion of the heat exchanger 11 indicated by symbol F1 shown in FIG. 2, and shows a point at which the heating flow passage 61 and the cooling flow passage 62 cross each other. As shown in FIG. 4, the folded-back portion of the heating flow passage 61 includes a raised portion 70. An upper surface of the raised portion 70 forms a part of the heating flow passage 61, and a part of the cooling flow passage 62 is formed in the raised portion 70. The heating fluid in the heating flow passage 61 flows over the raised portion 70, while the cooling fluid in the cooling flow passage 62 flows through the inside of the raised portion 70. Specifically, the heating fluid flows over the raised portion 70 (i.e., above the cooling fluid), while the cooling fluid flows under the heating fluid.

In a portion of the heat exchanger 11 indicated by symbol F2 shown in FIG. 2, a raised portion 70 is formed at the folded-back portion of the cooling flow passage 62. An upper surface of the raised portion 70 forms a part of the cooling flow passage 62, and a part of the heating flow passage 61 is formed in the raised portion 70. The cooling fluid in the cooling flow passage 62 flows over the raised portion 70, while the heating fluid in the heating flow passage 61 flows through the inside of the raised portion 70. Specifically, the cooling fluid flows over the raised portion 70 (i.e., above the heating fluid), while the heating fluid flows under the cooling fluid.

Figure 5:
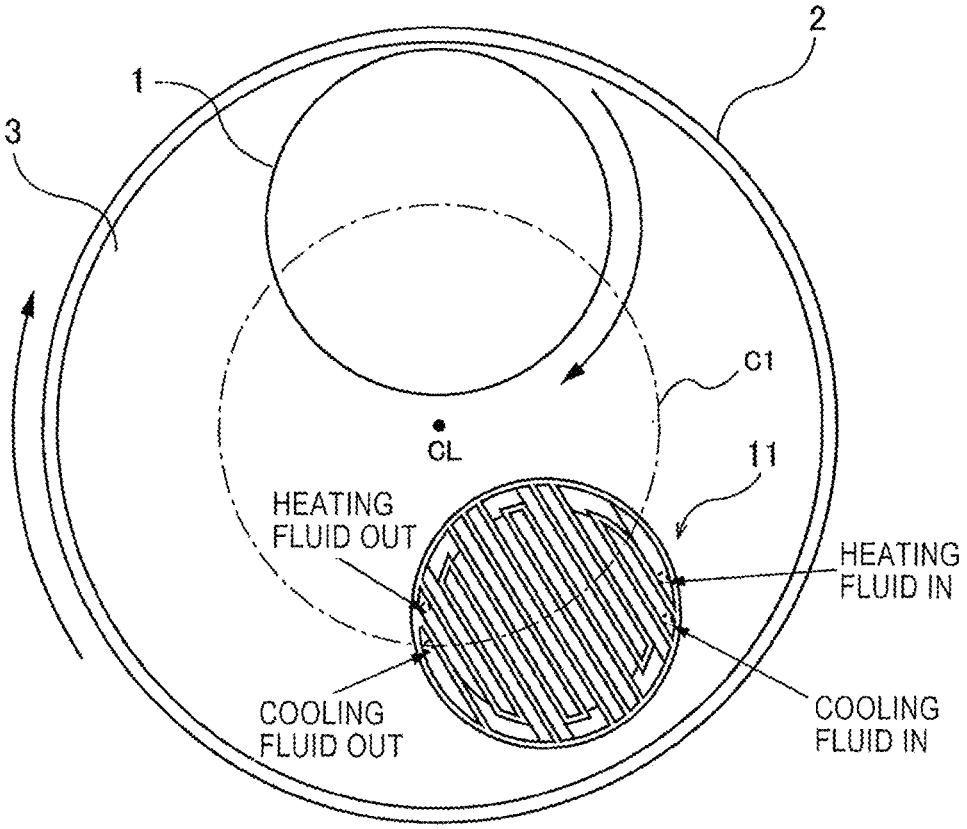
FIG. 5 is a plan view showing a positional relationship between the heat exchanger and a polishing head on a polishing pad.

FIG. 5 is a plan view showing a positional relationship between the heat exchanger 11 and the polishing head 1 on the polishing pad 3. The heat exchanger 11 has a circular shape when viewed from above, and has a diameter which is smaller than the diameter of the polishing head 1. A distance from the center CL of the polishing pad 3 to the center of the heat exchanger 11 is equal to a distance from the center CL of the polishing pad 3 to the center of the polishing head 1. Since the heating flow passage 61 and the cooling flow passage 62 are adjacent to each other, the heating flow passage 61 and the cooling flow passage 62 are arranged along the circumferential direction of the polishing pad 3. Further, the raised portions 70, at which the heating flow passage 61 and the cooling flow passage 62 cross each other, are arranged along the circumferential direction of the polishing pad 3, and are located at an inner region and an outer region of the peripheral portion of the pad contact surface 65. While the polishing table 2 and the polishing pad 3 are rotating, the polishing pad 3 in contact with the heat exchanger 11 performs the heat exchange with both of the heating fluid and the cooling fluid.

Both the heating flow passage 61 and the cooling flow passage 62 are located over the entirety of the pad contact surface 65. In particular, both the heating fluid and the cooling fluid are present at points where the heating flow passage 61 and the cooling flow passage 62 cross each other. This arrangement can prevent the local heating with only the heating fluid and the local cooling with only the cooling fluid. In other words, the heat exchanger 11 can regulate the surface temperature of the polishing pad 3 by both the heating fluid and the cooling fluid in the entirety of the pad contact surface 65. Therefore, the heat exchanger 11 can provide a uniform distribution of the surface temperature of the polishing pad 3. Furthermore, the polishing apparatus having the above-discussed heat exchanger 11 can polish a substrate, such as a wafer, to provide a uniform polishing profile.

In order to maintain the pad surface temperature at a predetermined target temperature, the heat exchanger 11 is placed in contact with the surface (i.e. the polishing surface 3*a*) of the polishing pad 3 during polishing of the wafer W. In this specification, the manner of contact of the heat exchanger 11 with the surface of the polishing pad 3 includes not only direct contact of the heat exchanger 11 with the surface of the polishing pad 3, but also contact of the heat exchanger 11 with the surface of the polishing pad 3 in the presence of a polishing liquid (or slurry) between the heat exchanger 11 and the surface of the polishing pad 3. In either case, the heat exchange occurs between the polishing pad 3 and the heating fluid and cooling fluid, flowing in the heat exchanger 11, whereby the pad surface temperature is controlled.

Figure 6:
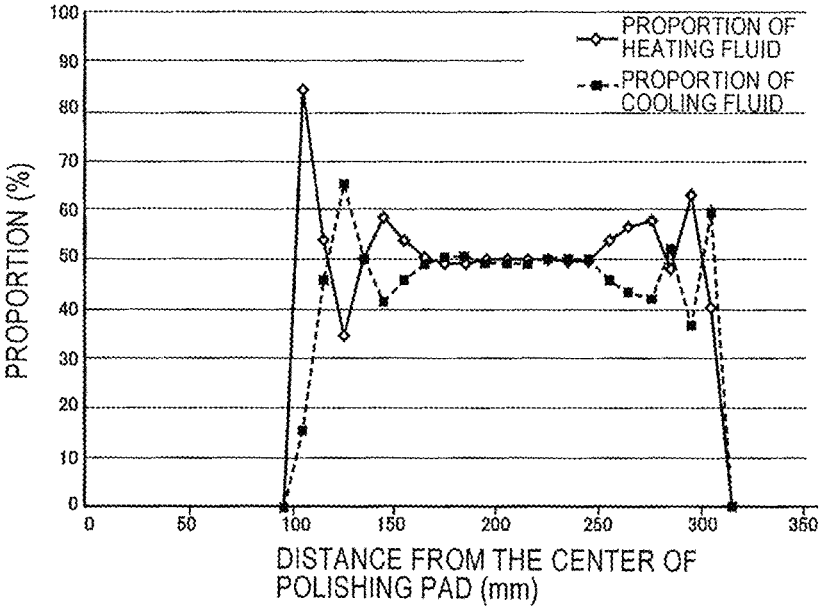
FIG. 6 is a graph showing proportions of a heating fluid and a cooling fluid in the heat exchanger existing on a circle (imaginary circle) which is concentric with the polishing pad.

FIG. 6 is a graph showing proportions of the heating fluid and the cooling fluid in the heat exchanger 11 existing on a circle (imaginary circle) concentric with the polishing pad 3. A vertical axis of FIG. 6 represents the proportions of the heating fluid and the cooling fluid, and a horizontal axis represents radius of the concentric circle, i.e., distance from the center CL of the polishing pad 3. A circle denoted by reference character C1 shown in FIG. 5 is one of concentric circles.

As shown in FIG. 6, both the heating fluid and the cooling fluid exist throughout the entirety of the heat exchanger 11 from the inner end to the outer end thereof. As can be seen from this graph, the pad contact surface 65 does not have a locally-heating region with only the heating fluid and a locally-cooling region with only the cooling fluid. Furthermore, a ratio of the heating fluid to the cooling fluid at the center of the heat exchanger 11 is 50:50. Therefore, the heat exchanger 11 can provide the uniform surface temperature of the polishing pad 3.

Figure 7:
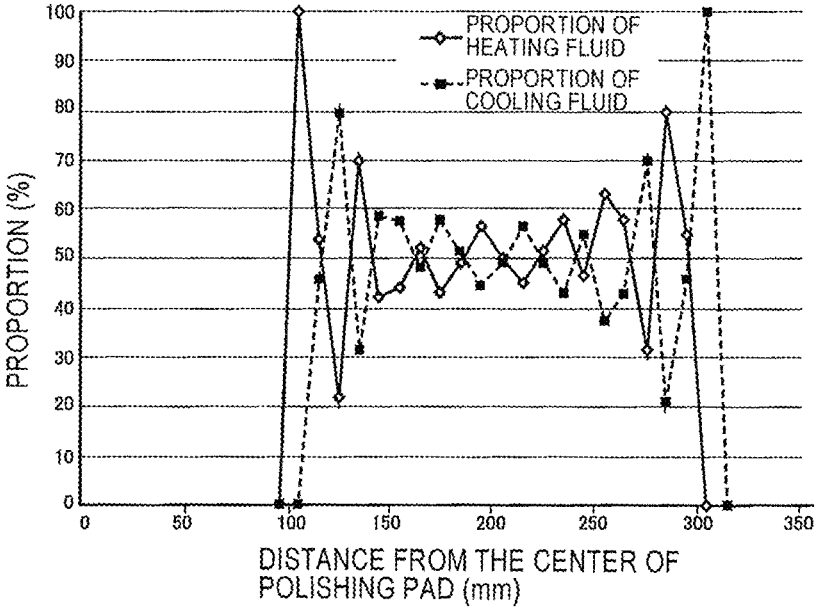
FIG. 7 is a graph showing proportions of a heating fluid and a cooling fluid in a conventional heat exchanger shown in FIG. 13.
Figure 13:
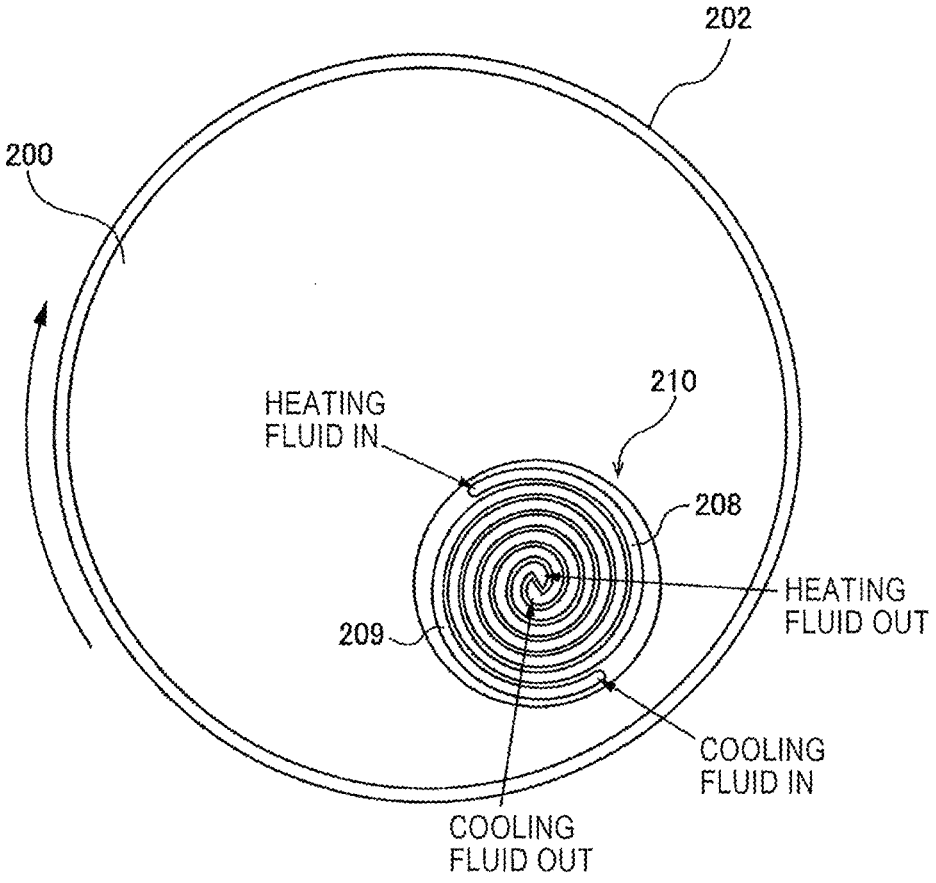
FIG. 13 is a view showing another example of a conventional heat exchanger.

FIG. 7 is a graph showing proportions of a heating fluid and a cooling fluid in the conventional heat exchanger 210 shown in FIG. 13. As shown in FIG. 7, only the heating fluid exists at the inner end of the heat exchanger 210, and only the cooling fluid exists at the outer end of the heat exchanger 210. As a result, the pad contact surface of the heat exchanger 210 shown in FIG. 13 has a locally-heating region with only the heating fluid and a locally-cooling region with only the cooling fluid.

Figure 8:
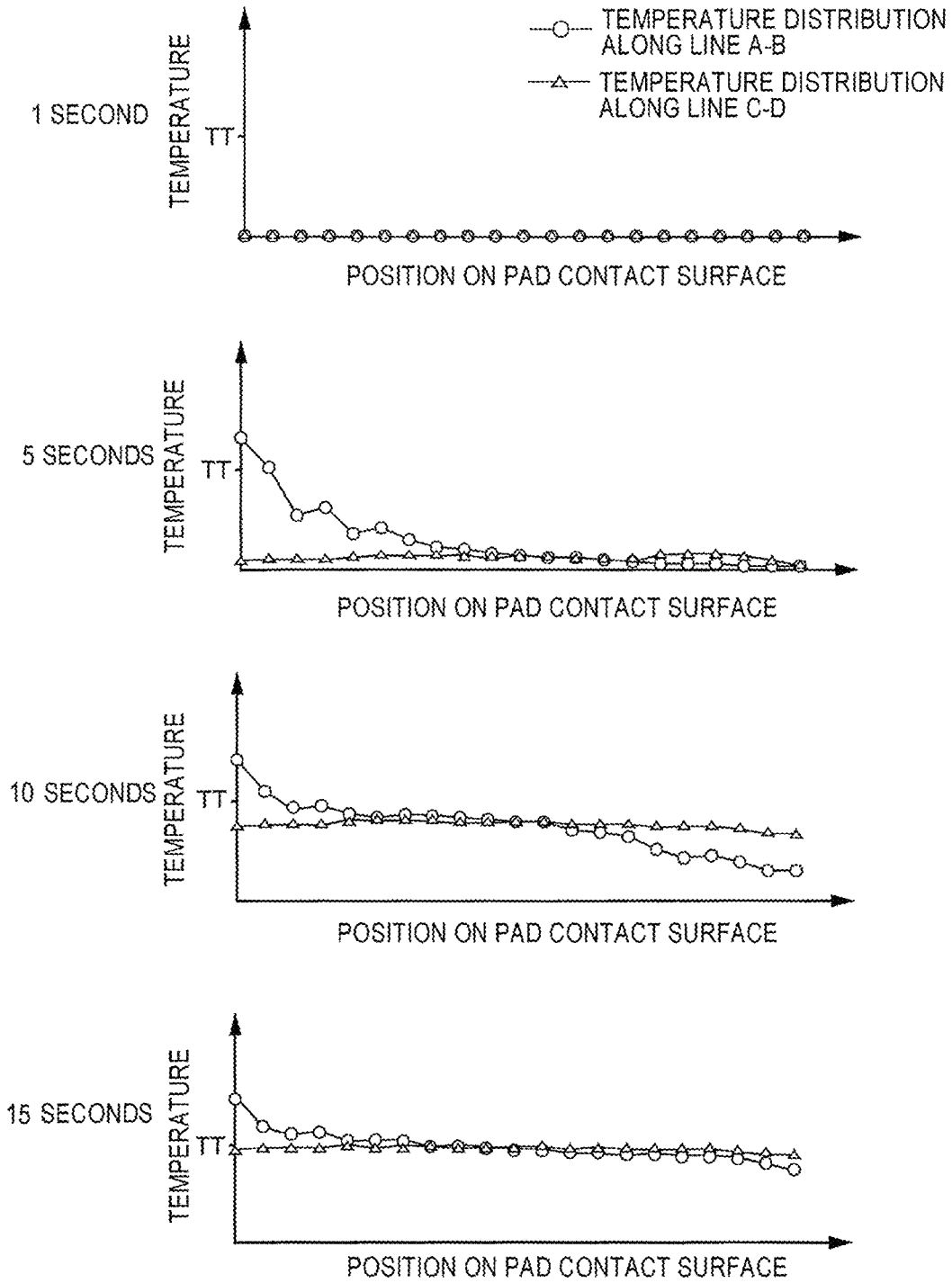
FIG. 8 is a graph showing simulation results of the temperature change of the pad contact surface with the elapse of time when the heating fluid and the cooling fluid are passed at the same flow rate to the heat exchanger according to the present embodiment.

FIG. 8 is a graph showing simulation results of the temperature change of the pad contact surface 65 with the elapse of time when the heating fluid and the cooling fluid are passed at the same flow rate to the heat exchanger 11 according to the present embodiment. In FIG. 8, a vertical axis represents the temperature of the pad contact surface 65 and a horizontal axis represents position on the pad contact surface 65. Symbol TT represents a target temperature of the pad contact surface 65. This graph shows a temperature distribution of the pad contact surface 65 along a line A-B shown in FIG. 3 and shows a temperature distribution of the pad contact surface 65 along a line C-D. It can be seen from these simulation results that the temperature of the pad contact surface 65 has reached the target temperature TT after 15 seconds have elapsed from the start of passing the heating fluid and the cooling fluid to the heat exchanger 11, and that a substantially uniform temperature distribution was obtained over the entirety of the pad contact surface 65.

Figure 9:
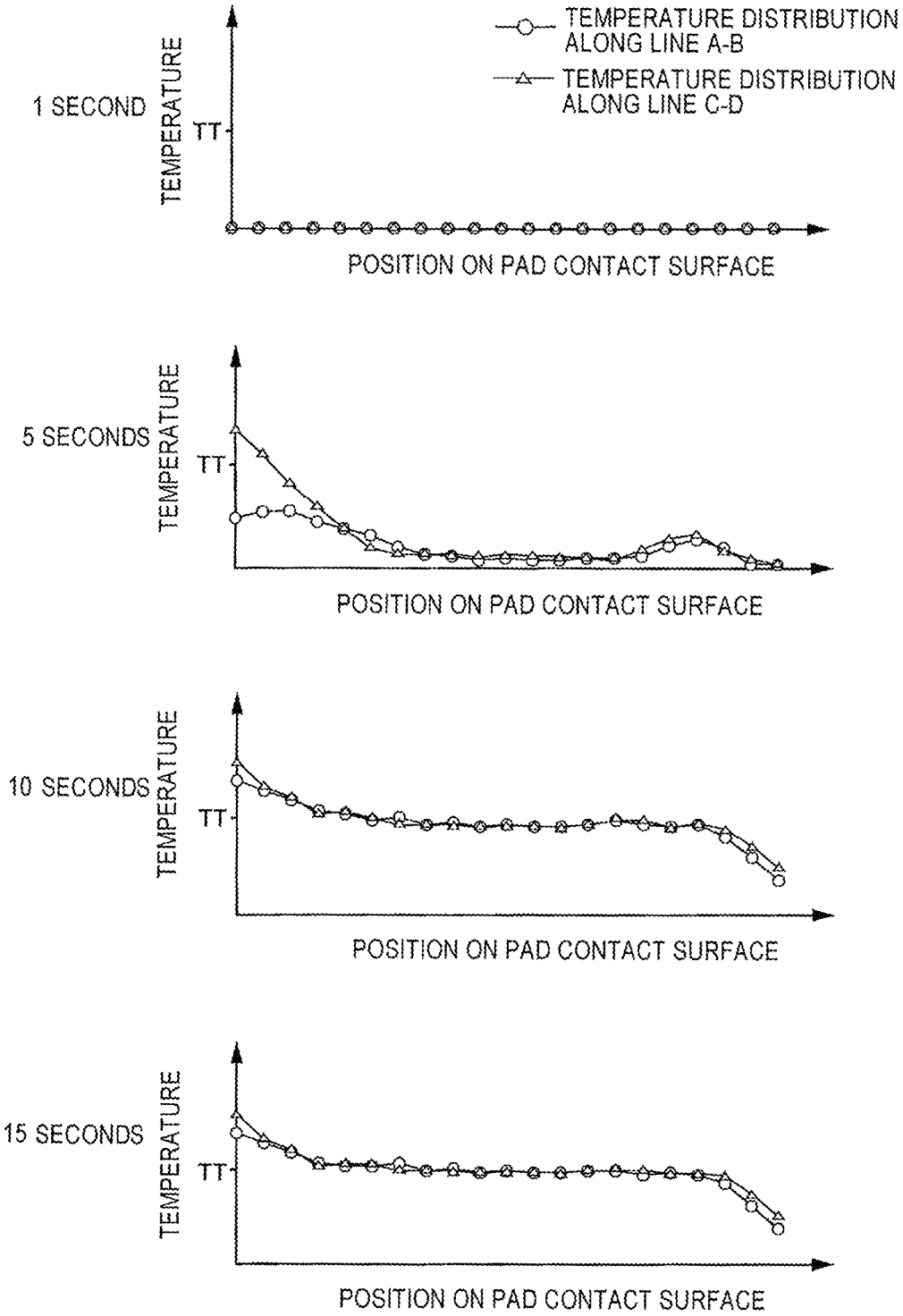
FIG. 9 is a graph showing simulation results of the temperature change of a pad contact surface with the elapse of time when a heating fluid and a cooling fluid are passed at the same flow rate to the conventional heat exchanger shown in FIG. 13.

FIG. 9 is a graph showing simulation results of the temperature change of the pad contact surface with the elapse of time when the heating fluid and the cooling fluid are passed at the same flow rate to the conventional heat exchanger 210 shown in FIG. 13. A temperature distribution along a line A-B shown in FIG. 9 is a temperature distribution along a line A-B (see FIG. 3) of the pad contact surface of the conventional heat exchanger 210 shown in FIG. 13. A temperature distribution along a line C-D shown in FIG. 9 is a temperature distribution along a line C-D (see FIG. 3) of the pad contact surface of the conventional heat exchanger 210 shown in FIG. 13. It can be seen from these simulation results that the end portion of the pad contact surface did not reach the target temperature TT even when 15 seconds have elapsed from the start of passing the heating fluid and the cooling fluid to the heat exchanger 210.

Figure 10:
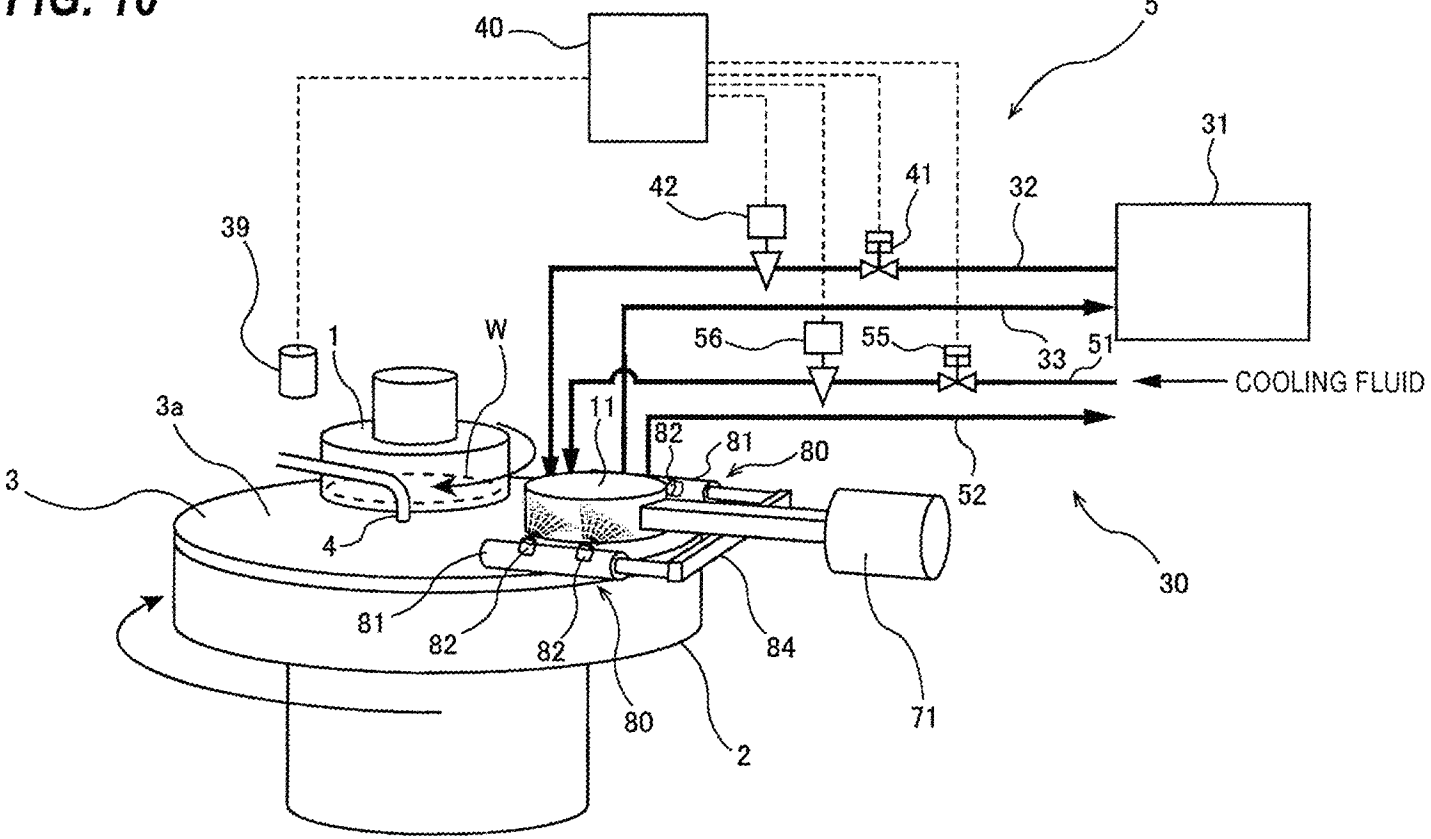
FIG. 10 is a view showing another embodiment of the polishing apparatus.

FIG. 10 is a view showing another embodiment of the polishing apparatus. Structures of this embodiment, which will not be specifically described, are the same as those of the embodiment shown in FIG. 1 to FIG. 6, and duplicate explanations will be omitted. As shown in FIG. 10, the polishing apparatus of the present embodiment includes cleaning mechanisms 80, 80 for cleaning side surfaces of the heat exchanger 11. The cleaning mechanisms 80, 80 are disposed at both sides of the heat exchanger 11 and are fixed to an arm 84. The arm 84 is fixed to the translation mechanism 71. The cleaning mechanisms 80, 80 are movable together with the heat exchanger 11.

Each cleaning mechanism 80 includes a header tube 81 communicating with a cleaning-liquid supply source (not shown) and a plurality of spray nozzles 82 mounted to the header tube 81. The header tube 81 is arranged along the side surface of the heat exchanger 11, and the plurality of spray nozzles 82 are directed toward the side surface of the heat exchanger 11. A cleaning liquid, supplied from the cleaning-liquid supply source, is sprayed from the spray nozzles 82 toward both side surfaces of the heat exchanger 11, thereby removing the polishing liquid (for example, slurry) adhering to the side surfaces of the heat exchanger 11. Pure water may be used as the cleaning liquid. It is preferable that the heat exchanger 11 be cleaned when the heat exchanger 11 is at a retreat position.

Figure 11:
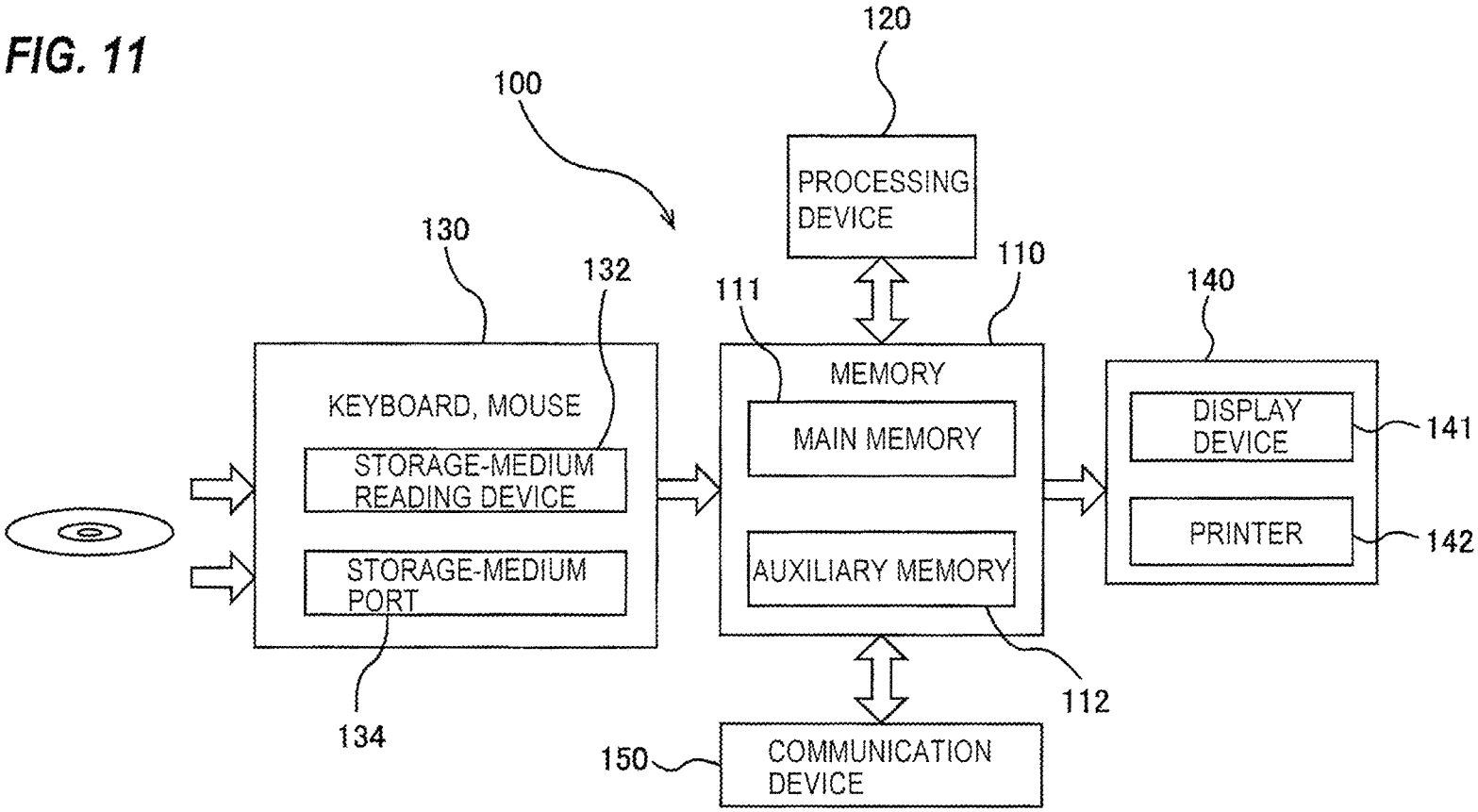
FIG. 11 is a schematic diagram showing an operation controller for controlling the operation of the polishing apparatus.
Figure 12:
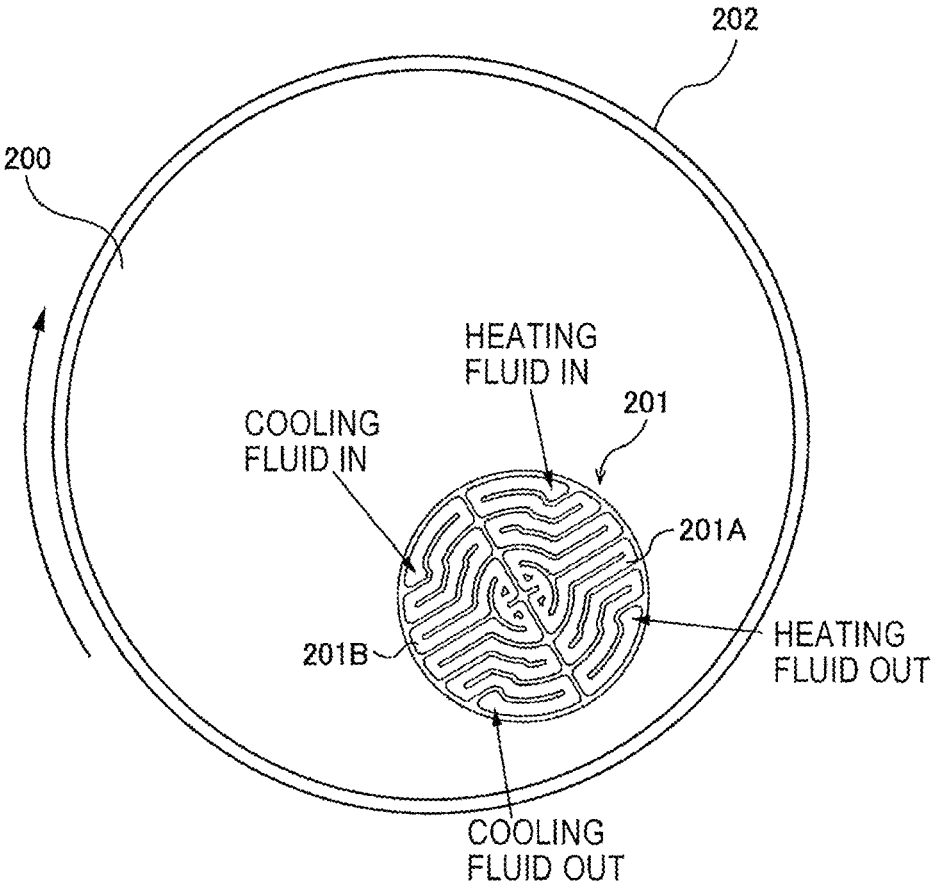
FIG. 12 is a diagram showing an example of a conventional heat exchanger.

In the above-described embodiments, the operation of the polishing apparatus is controlled by an operation controller 100 shown in FIG. 11. The operation controller 100 is constituted by a dedicated computer or a general-purpose computer. As shown in FIG. 11, the operation controller 100 includes a memory 110 in which a program and data are stored, a processing device 120, such as CPU (central processing unit), for performing arithmetic operation according to the program stored in the memory 110, an input device 130 for inputting the data, the program, and various information into the memory 110, an output device 140 for outputting processing results and processed data, and a communication device 150 for connecting to a network, such as the Internet.

The memory 110 includes a main memory 111 which is accessible by the processing device 120, and an auxiliary memory 112 that stores the data and the program therein. The main memory 111 may be a random-access memory (RAM), and the auxiliary memory 112 is a storage device which may be a hard disk drive (HDD) or a solid-state drive (SSD).

The input device 130 includes a keyboard and a mouse, and further includes a storage-medium reading device 132 for reading the data from a storage medium, and a storage-medium port 134 to which a storage medium can be connected. The storage medium is a non-transitory tangible computer-readable storage medium. Examples of the storage medium include optical disk (e.g., CD-ROM, DVD-ROM) and semiconductor memory (e.g., USB flash drive, memory card). Examples of the storage-medium reading device 132 include optical disk drive (e.g., CD drive, DVD drive) and card reader. Examples of the storage-medium port 134 include USB terminal. The program and/or the data stored in the storage medium is introduced into the operation controller 100 via the input device 130, and is stored in the auxiliary memory 112 of the memory 110. The output device 140 includes a display device 141 and a printer 142.

The operation controller 100 operates according to the program electrically stored in the memory 110. Specifically, the operation controller 100 instructs the polishing head 1 to hold a substrate with the polishing head 1, and instructs the pad-temperature regulation system 5 to bring the heat exchanger 11 into contact with the surface 3*a* of the polishing pad 3 to regulate the surface temperature of the polishing pad 3, and further instructs the polishing head 1 to press the substrate against the surface 3*a* of the polishing pad 3 to polish the substrate, while regulating the surface temperature of the polishing pad 3 with the heat exchanger 11 through which the heating fluid and the cooling fluid flow.

The program for causing the operation controller 100 to perform these steps is stored in a non-transitory tangible computer-readable storage medium. The operation controller 100 is provided with the program via the storage medium. The operation controller 100 may be provided with the program via communication network, such as the Internet.

In one embodiment, in place of the translation mechanism 71 shown in FIGS. 1 and 10, a rotating mechanism for rotating the heat exchanger 11 may be provided at a distal end of an arm. In this embodiment, the heating-fluid inlet 61*a*, the cooling-fluid inlet 62*a*, the heating-fluid outlet 61*b*, and the cooling-fluid outlet 62*b* of the heat exchanger 11 are provided near the center of rotation of the heat exchanger 11. Also in this embodiment, the heating flow passage 61 and the cooling flow passage 62 are arranged side by side from the beginnings to the ends thereof, and the heating flow passage 61 and the cooling flow passage 62 cross each other at different levels at the peripheral portion of the pad contact surface 65. The heat exchanger 11 having such a configuration is placed in contact with the surface 3*a* of the polishing pad 3 while the heat exchanger 11 is rotated by the rotating mechanism. As a result, the surface temperature of the polishing pad 3 can be more uniform.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A heat exchanger for regulating a surface temperature of a polishing pad by contacting a surface of the polishing pad, comprising:

a pad contact surface capable of contacting the polishing pad;

a heating flow passage through which a heating fluid is to flow; and a cooling flow passage through which a cooling fluid is to flow, wherein the heating flow passage and the cooling flow passage are arranged side by side from beginnings to ends thereof, and the heating flow passage and the cooling flow passage cross each other at different levels at a peripheral portion of the pad contact surface.

2. The heat exchanger according to claim 1, wherein the heating flow passage and the cooling flow passage comprise zigzag passages.

3. The heat exchanger according to claim 2, wherein folded-back portions of the heating flow passage and folded-back portions of the cooling flow passage overlap each other.

4. The heat exchanger according to claim 2, wherein folded-back portions of the heating flow passage and folded-back portions of the cooling flow passage are located right above the peripheral portion of the pad contact surface.

5. A polishing apparatus comprising:

a rotatable polishing table for supporting a polishing pad;

a polishing head configured to press a substrate against a surface of the polishing pad so as to polish the substrate;

a heat exchanger configured to contact the surface of the polishing pad so as to regulate a surface temperature of the polishing pad;

a heating-fluid supply pipe configured to supply a heating fluid to the heat exchanger; and a cooling-fluid supply pipe configured to supply a cooling fluid to the heat exchanger, the heating exchanger comprising a heating exchanger according to claim 1.

6. A substrate polishing method comprising:

holding a substrate with a polishing head; and pressing the substrate by the polishing head against a surface of a polishing pad to polish the substrate, while placing a heat exchanger, through which a heating fluid and a cooling fluid flow, in contact with the surface of the polishing pad so as to regulate a surface temperature of the polishing pad, the heat exchanger comprising a heat exchanger according to claim 1.

7. A non-transitory computer-readable storage medium storing therein a program that instructs a computer to perform a substrate polishing method recited in claim 6, the computer being configured to control operations of a polishing apparatus.

* * * * *